United States Patent [19]

Hamrick et al.

[11] Patent Number: 4,699,197

[45] Date of Patent: Oct. 13, 1987

[54] ELECTROMECHANICALLY ACTUATED BIFOLDING CLOSURE APPARATUS

[76] Inventors: Jerry O. S. Hamrick, 200 Burnham Ct., #C; Claude A. S. Hamrick, 1560 Salacci, both of Campbell, Calif. 95008

[21] Appl. No.: 887,732

[22] Filed: Jul. 21, 1986

[51] Int. Cl.[4] ..... E05F 17/00; E05F 15/10; E01F 13/00

[52] U.S. Cl. ..... 160/188; 160/199; 49/9; 49/334; 49/337

[58] Field of Search ..... 49/9, 334, 337; 160/188, 199, 213

[56] References Cited

U.S. PATENT DOCUMENTS

| | | | |
|---|---|---|---|
| 345,587 | 7/1886 | Hanley | 49/9 |
| 1,160,198 | 11/1915 | Phillips | 160/199 |
| 1,405,315 | 1/1922 | Moore | 160/188 |
| 1,698,652 | 1/1929 | Petersen | 160/188 |
| 1,736,390 | 11/1929 | Brubaker | 160/188 |
| 1,746,270 | 2/1930 | Meincu | 49/9 |
| 1,832,232 | 11/1931 | Mimms | 49/9 X |
| 1,863,310 | 6/1932 | Krage | 49/9 |
| 2,561,623 | 7/1951 | Hall | 49/337 |
| 2,929,445 | 3/1960 | Haws | 160/199 |
| 3,289,741 | 12/1966 | Gossling | 160/188 |

*Primary Examiner*—Ramon S. Britts
*Assistant Examiner*—Cherney S. Lieberman

[57] ABSTRACT

Electromechanically actuated bifolding closure apparatus including a vertical support post; a pair of generally C-shaped frame members disposed in facing relationship and pivotally joined together at their distal extremities such that in a closed disposition the two C-shaped members lie in a single plane and form a rectangularly configured super-structure, and in an opened disposition lie in different, spaced apart parallel planes rotated either 90 degrees relative to or parallel to the closed plane; hinge apparatus pivotally connecting one of said C-shaped units to the vertical post; a motive power source carried by one of the C-shaped members at a position proximate the support post; a gear drive mechanism associated with the hinging apparatus at the post and at the pivotal connection of at least one set of the distal ends of the C-shaped members; and a mechanical drive linkage coupling the motive power source to each of the gear mechanisms, such that when the motor caused the associated drive linkage to be rotated in one direction, the structure is rotated from a closed position to an open position, and when the motor causes the drive linkage to be rotated in the other direction, the structure is rotated from the open position to the closed position.

21 Claims, 22 Drawing Figures

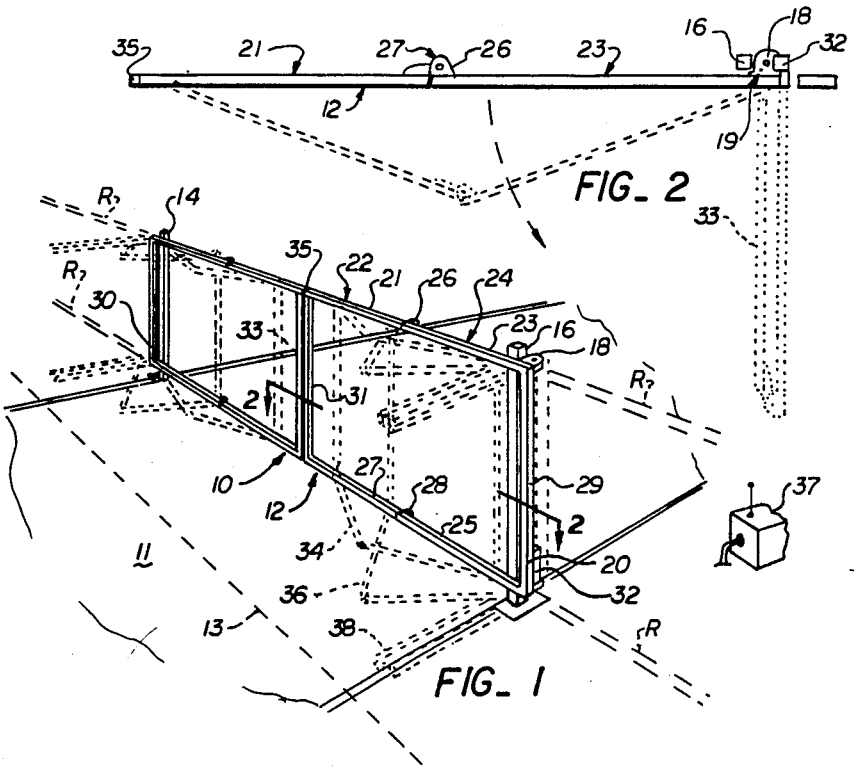
FIG. 2
FIG. 1
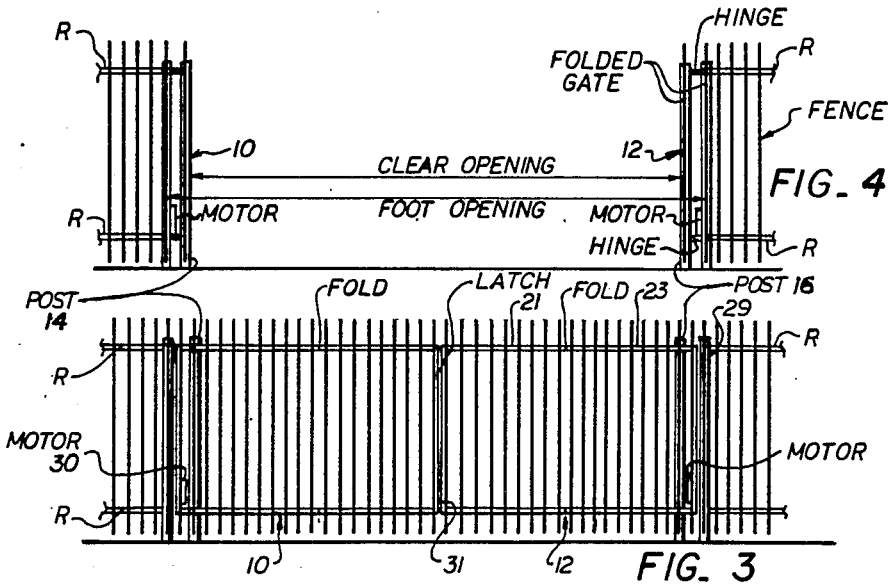
FIG. 4
FIG. 3

40
44
42
48
58
64
65
46
47
65
52
44
59
66
20
60
62
40
16
43

8
118
116
32
106
110
114
112
108
104
29
102
100
98
16
43
40
42
48
84
86
70
25
82
74
88
78
90
94
92
20

8
40
55
56
57
48
20
44
46
16
7
50
58
54
42
62
52
53
66
152
98
150
156
96
25
154
60
94
158
70
82
6
6
80
72
74
84
88
86
78
76
90
92

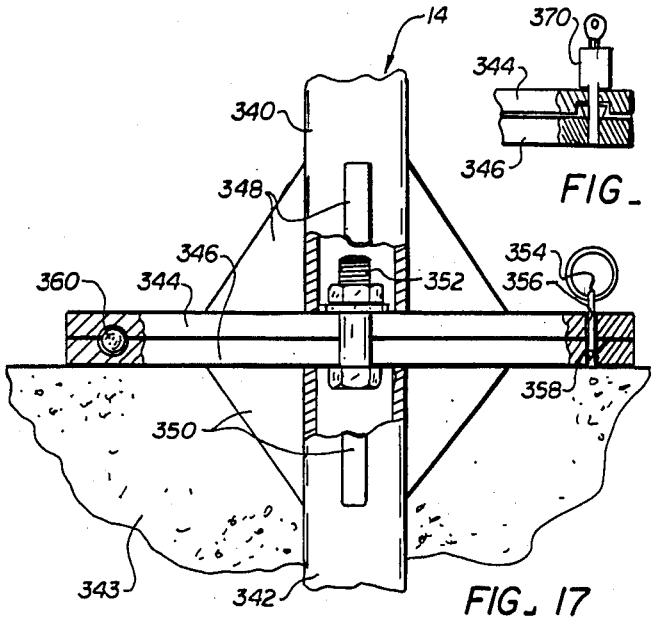
FIG. 18
FIG. 17
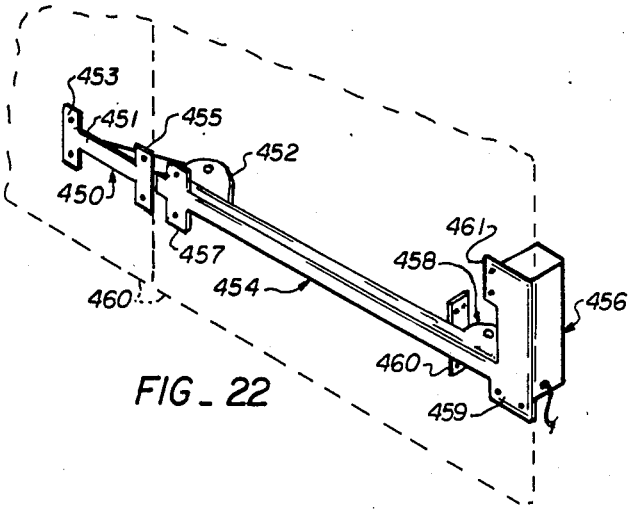
FIG. 22

ELECTROMECHANICALLY ACTUATED BIFOLDING CLOSURE APPARATUS

BACKGROUND OF THE INVENTION

1. Field of the Invention

The present invention relates generally to fence gates and similar closure apparatus, and more particularly to a novel bifold closure super-structure and apparatus having on-board electromechanical drive apparatus for moving a closure between its open and closed positions.

2. Discussion of the Prior Art

Heretofore, fence gates and large closure doors have either been of the swinging type, wherein either one or two panels are pivotly connected to side posts and rotated at least 90° degrees from a closed position to an open position, or of the sliding type in which one or more panels is mounted on a track or on rollers of one configuration or another and slideably moved between a closed position and an open position.

The problem with the former configuration is that it requires the swinging of a rather large gate unit, or pair of gate units, and requires a correspondingly large free ground surface area over which the gate unit(s) may be rotated and parked. In addition, if the gate(s) must be opened outwardly, sufficient room for an incoming vehicle must be provided. Whereas this configuration may be suitable for some applications in which space is available, there are certain applications to which such a gate cannot be used, or is impractical for use due to limited space, sloping ground surface, etc.

For many applications in which the swinging gate configuration is inappropriate, the sliding configuration can be used. In the case of a sliding gate, when moved into the open position the gate is merely "parked" beside an adjacent section of fence. This is in many situations a quite suitable arrangement, particularly when the gate is disposed at a point along the length of a long straight section of fence.

However, for those cases where it is not possible to provide room within which to swing or slide the gate panels, it may be possible that neither of the above types of gate can be utilized. For such situations it has been necessary to utilize other specialized, nonstandard configurations involving an overhead, rolling or guillotine type structure, or even a cantilevered, flag type of gate mounted similar to railroad type crossing barriers.

Another problem associated with swinging and sliding gates involves the mechanism required to accomplish automatic and/or remote actuation of the opening and closing operation. In swinging gates, a relatively long swinging arm is usually affixed to an actuating mechanism in a large black box positioned beside each gate unit. The actuating mechanism is typically some type of motor driven crank that in rotating the arm causes the gate unit to likewise be rotated from one position to the other.

In the case of the sliding gate, a similar large black box is used to drive a cable, chain, or rack and pinion mechanism for moving the gate along its opening/closing path.

Aside from the aesthetic interference of the "black boxes" with the overall appearance of the gate and fence combination, these devices normally require costly mounting pads, special electrical wiring and give rise to other undesirable requirements.

With regard to large openings requiring closures, such as aircraft hangers, warehouses, large garages, etc., similar problems are encountered, except that in many of these cases it is possible to use an overhead track mounted closure. However, there are other applications in which less than suitable closure carrying and actuating mechanisms must be utilized for want of better solutions.

Still another problem associated with many prior art gate and closure structures is that they do not provide adequate crash barrier protection suitable for limiting the intrusion of heavy vehicles bent upon penetrating the closure.

A similar disadvantage relating to concussion caused damage is found in many track mounted hanger doors; that is, a substantial shock or pressure wave may dislodge the door rollers from the track and render the door unopenable without disassembly, the use of jacks, etc.

A still further problem associated with prior art gating structures is the difficulty of providing incipient intrusion warning and avoidance features.

SUMMARY OF THE PRESENT INVENTION

It is therefore a principal object of the present invention to provide a novel closure super-structure which can be used as either a gate support or a closure support mechanism, and which bifolds from a closed position into an open position occupying a relatively small footprint proximate the mounting post or adjacent wall or fence.

Another object of the present invention is to provide a device of the type described which does not require tracks or rollers in order to guide the bifolding closure components from their open to the entire closed position and visa versa.

A further object of the present invention is to provide a device of the type described in which no external mechanical control linkages are required in order to effect the opening and closing operation.

Still another object of the present invention is to provide an apparatus of the type described in which all drive motors and operating linkages are carried on-board the closure super-structure per se.

Yet another object of the present invention is to provide a device of the type described which is capable of eing fitted with appropriate intrusion detection and alarm mechanisms.

A still further object of the present invention is to provide a device of the type described which includes intrusion restraint means for arresting attempted penetration of the closure.

Another objective of the present invention is to provide a large bifolding closure structure and mechanism which will not be disabled by non-destructive concussion forces.

Still another object of the present invention is to provide an electromechanical actuating apparatus of the type described which can be attached to a bifolding closure to provide automatic opening and closing thereof.

Briefly, a preferred embodiment of the present invention includes one or more closure carrying support units, each of which is comprised of a vertical support post; a pair of generally C-shaped frame members disposed in facing relationship and pivotly joined together at their distal extremities such that in a closed disposition the two C-shaped members lie in a single plane and form a rectangularly configured super-structure, and in an opened disposition lie in different, spaced apart parallel planes rotated either 90 degrees relative to or parallel to the closed plane; hinge apparatus pivotly connecting one of said C-shaped units to the vertical post; a motive power source carried by one of the C-shaped members at a position proximate the support post; a gear drive mechanism associated with the hinging apparatus at the post and at the pivotal connection of at least one set of the distal ends of the C-shaped members; and a mechanical drive linkage coupling the motive power source to each of the gear mechanisms, such that when the motor caused the associated drive linkage to be rotated in one direction, the structure is rotated from a closed position to an open position, and when the motor causes the drive linkage to be rotated in the other direction, the structure is rotated from the open position to the closed position.

An important advantage of the present invention is that it provides a universal bifolding super-structure which can be scaled up or down and upon which any suitable gate or closure apparatus can be mounted.

Another important advantage of the present invention is that since its drive mechanism is carried by the super-structure itself, no outboard linkages, drive chains or other drive mechanisms are required.

Still another advantage of the present invention is that the super-structure can be shipped independent of the closure apparatus, be assembled at the site, and then have the closure apparatus mounted thereto.

Yet another advantage of the present invention is that in one embodiment it is adapted to include intrusion detection and/or prevention features.

A still further advantage of the present invention is that it can be implement in any size to carry any type or size of closure.

These and other objects and advantages of the present invention will no doubt become apparent to those of ordinary skill in the art after having read the following detailed description of the preferred embodiments which are illustrated in the several figures of the drawing.

IN THE DRAWING

FIG. 1 is a perspective view schematically illustrating a bifolding closure super-structure in accordance with the present invention;

FIG. 2 is a sectional view taken along the line 2—2 and illustrating one unit of the forearm, upper arm and shoulder portion of the super-structure illustrated in FIG. 1;

FIG. 3 is a front elevational view showing the super-structure of FIG. 1 with vertical pickets affixed thereto to provide a gate for a picket type fence;

FIG. 4 is a front elevational view showing the gate of FIG. 3 in its open position;

Figure 16:
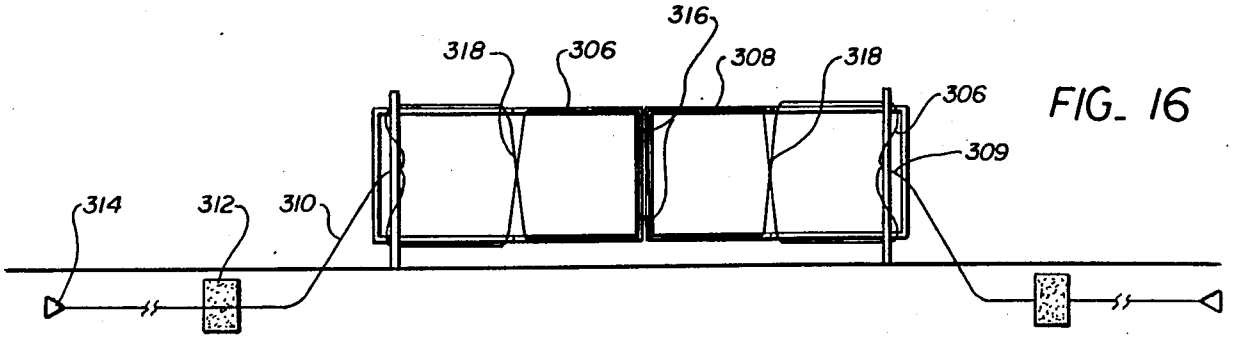

FIG. 16 schematically illustrates an alternative embodiment of a gate and crash restraint system in accordance with the present invention;

FIG. 17 illustrates a post base configuration for protecting the drive gear train in the event of a gate crashing impact;

FIG. 18 shows an alternative lockable shear pin for the embodiment of FIG. 17.

Figure 19:
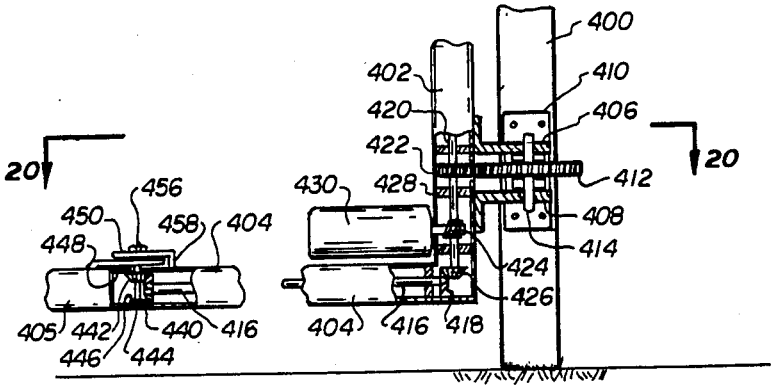
Figure 20:
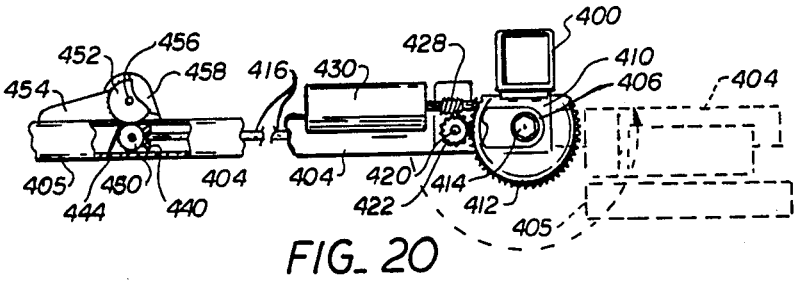
Figure 21:
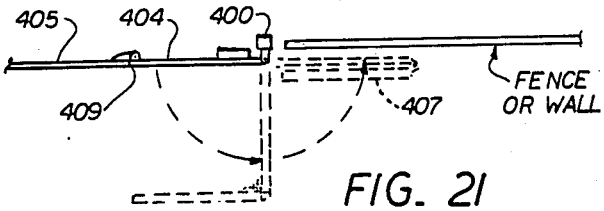

FIG. 19 is a partially broken elevational view illustrating an alternative embodiment of a drive mechanism in accordance with the present invention;

FIGS. 20 and 21 further illustate the alternative embodiment of the present invention shown in FIG. 19 and designed to swing the opened bifolding closure substantially 180 degrees relative to its closed position; and FIG. 22 is a perspective view illustrating another alternative embodiment of the invention which can be used in association with independently suspended bifolding gates or other closures.

DETAILED DESCRIPTION OF THE PREFERRED EMBODIMENTS

In FIG. 1 of the drawings, a perspective view is shown illustrating a closure super-structure in accordance with the present invention as implemented in a double bifold gate supporting embodiment. The illustrated embodiment includes a pair of bifold units 10 and 12 respectively mounted to vertical posts 14 and 16 normally sunk in concrete on either side of a drive or other paved surface. Attachment of each of the units 10 and 12 to posts 14 and 16 is accomplished by means of upper and lower hinge pin mechanisms 18 and 20 (right side) which will be described in more detail below.

Each of the bifolding units 10 and 12 includes a pair of generally C-shaped frames 22 and 24 normally fabricated of tubular metal of rectangular cross-section. The two C-shaped frames are juxtapositioned with their open sides facing each other and have their distal extremities joined together at top and bottom by means of hinging mechanisms 26 and 28 which will be described in greater detail below.

The opening and closing of the bifold units is accomplished by drive motors 30 and 32, respectively mounted in the lower left and right hand corners of the units, and a drive train disposed within one or more of the tubular elements forming the C-shaped frame 24. The units 10 and 12 are latched together by suitable mechanical or electromechanical devices contained in or affixed to the elements 31 and 33.

The motors and associated position sensing and gate latching means are electrically connected to a control unit 37 by means of buried cables, the unit being remotely positioned at any suitable location. The unit 37 may include a radio controlled receiver for facilitating vehicle remote actuation of the gate and/or may be connected to a key locked or card locked entry acess station or other access station, or to any other type of access control means. In addition, the unit 37 may be integrated into an intrusion detection and/or burglar alarm system. One such system particularly suited for use with metal picket fences is disclosed in the co-pending U.S. patent application of Robert Husmann et al Ser. No. 767,174 filed 8-19-85.

As illustrated by the dashed lines in FIG. 1, as the motors 30 and 32 are energized, each super-structure unit is caused to fold from the extended or "closed" position illustrated in solid lines, through the intermediate positions illustrated by the dashed lines 34 and 36, to the folded or "open" position illustrated by the dashed lines 38. Note that the ground area swept by each unit is substantially less than that swept by a similarly sized swinging gate, and as a consequence can be used in situations where the fence line is positioned close to the roadside (indicated by dashed line 13). For example, in the case of a 20 foot gate, the maximum opening clearance required is less than 5 feet at each side. In the middle ten teet of the gate the clearance required is less than two feet. The advantages of such feature should be immediately apparent to those skilled in the art.

Reference is additionally made to FIG. 2 of the drawing which is a sectional view taken along line 2—2 of FIG. 1 and showing the lower elements of the right side unit 12 and post 16. The purpose of this figure is to illustrate the assembly including "forearm" 21, "elbow"0 27, "upper arm" 23 and "shoulder" 19 formed by the horizontally extending components constituting the lower and/or upper portions of each unit, and furthermore, to better depict the position of the pivot points 26 and 18 relative to the horizontal members 21 and 23, as well as relative to post 16. Note that when rotated into the open position shown by the dashed lines 38, the C-shaped units 22 and 24 are disposed in planes parallel to each other and at right angles to the fence line. Note also that the locus of motion of the closure extremity 35 is essentially a straight line coextensive with the position of the closed gate, while the locus of pivot point 26 traces an arcuate path from the closed position illustrated by the solid lines to the open position illustrated by the dashed lines 38.

Referring now to FIGS. 3 and 4, one example of an adornment of super-structure units 10 and 12 is illustrated wherein vertical pickets are affixed to the units by spot welding or using any other suitable means of attachment. Note that since the elevations of the horizontal components 21 and 23 of super-structure units 10 and 12 are the same as those of the upper and lower rails "R" of the adjoining fence, and the posts 14 and 18 are only slightly larger in dimension than the vertical superstructure members 31 and 29, the appearance of a continuous fence is provided by the gate.

In FIG. 4, the gate units 10 and 12 are shown rotated into their open positions to illustrate that the total frontal profile space required to accommodate the folded "open" gate units is less than one foot on each side in the case of a twenty foot opening. It will of course be appreciated that gates of both larger and smaller sizes than that illustrated can be accommodated in accordance with the present invention. It also will be appreciated that depending upon the particular application, either a single bifolding unit or an opposing pair of bifolding units (as illustrated) can be utilized to provide a closure for a particular opening.

Figures 5, 6, 7:
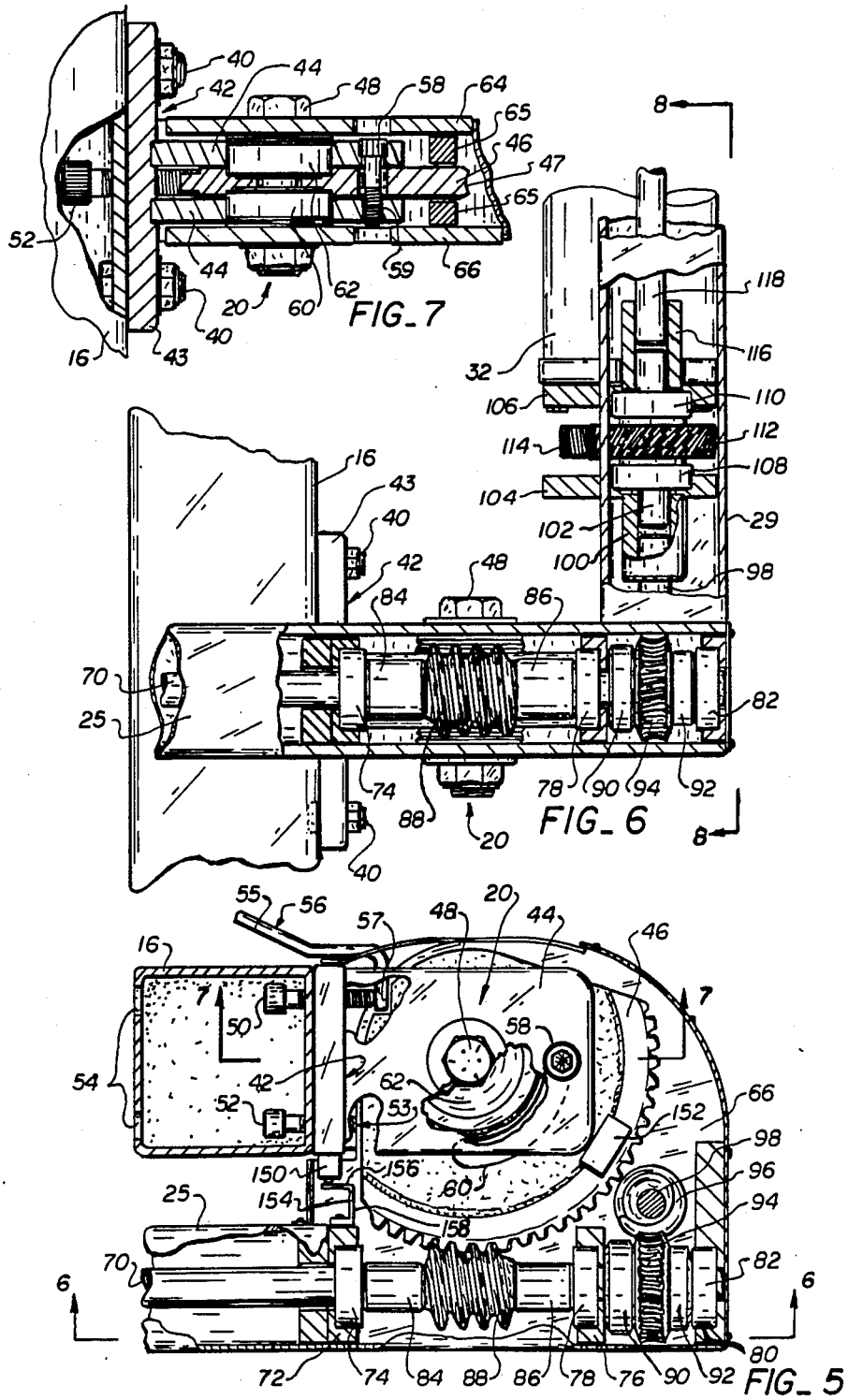
FIG. 5 is a partially broken plan view showing details of the lower hinge post, shoulder joint and drive train mechanisms of the present invention.
FIG. 6 is a partially broken front elevational view taken along line 6—6 of FIG. 5.
FIG. 7 is a partially broken cross sectional view taken along line 7—7 of FIG. 5.
Figure 8:
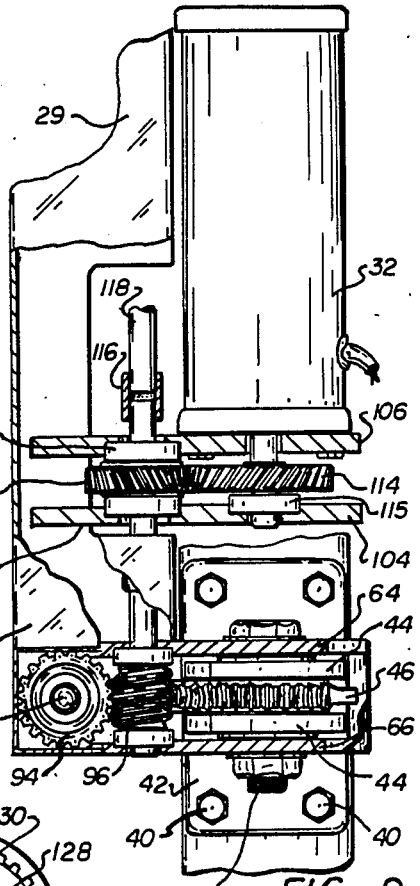
FIG. 8 is a partially broken side elevational view taken along the line 8—8 of FIG. 6.

In FIGS. 5–8 of the drawing, enlarged plan, side and cross-sectional views of a lower hinge and drive assembly ("shoulder assembly") in accordance with the invention are depicted in partially broken away detail to show various features thereof. In FIG. 6, a front elevational view taken along line 6—6 of FIG. 5 reveals certain details of the drive system, and in FIG. 7 a partially broken away section taken along the lines 7—7 illustrates the hinge, bracket and associated bearing structure. FIG. 8 is a broken side view taken along the line 8—8 of FIG. 6 and showing the motor drive coupling detail. As depicted, the assemblies of FIGS. 5–8 are disposed at the "lower shoulder" position, i.e., at pivot point 20 in FIG. 1. However, it is to be understood that a similar assembly could also be disposed at the "upper shoulder" position (at pivot point 18 of FIG. 1).

Attached to post 16 by means of 4 bolts 40 is a hinge bracket 42 (best shown in FIGS. 6 and 7) comprised of a vertical plate 43 having two spaced apart, horizontally extending plates 44 welded thereto to extend outwardly from post 16. Sandwiched between plates 44 is an arcuate segment of a main drive gear 46 disposed concentricity about the hinge pin 20 formed by a bolt 48.

The rotary positioning of gear 46 relative to post 16 is determined by a pair of set screws 50 and 52 (FIG. 5) which are accessed by an Allen wrench extended through openings 54 provided in the opposite side of post 16. Screw 52 directly engages a side surface of gear 46 at 53 to prevent clockwise rotation thereof, while screw 50 engages a release latch 56 which in turn bears against a notch 57 in the perimeter of gear 46, as indicated. It will be appreciated that whereas screw 50 allows adjustment of and prevents rotation of gear 46 about bolt 48 in the counter clockwise direction, bolt 52 allows adjustment of and prevents rotation of gear 46 in the clockwise direction.

However, by striking the distal end 55 of latch 56 with a hammer or other blunt object, the latch will be caused to pivot out of position between screw 50 and notched surface 57, thereby providing clearance between the distal end of screw 50 and gear 46. This provides an emergency release means which in effect disables the gate unit drive and allows the gate to be quickly opened in an emergency situation.

In order to ensure that the cantilevered extremities of plates 44 do not separate under load, a bolt 58 may be provided which threads into an opening 59 in the lower plate 44 and serves to clamp plates firmly into engagement with gear 46. In order to permit such clamping, yet still accommodate the emergency gate opening feature just mentioned, a slot 61 is provided in gear 46.

The plates 44 are journaled to bolt 48 by a pair of sealed bearings 60 and 62, as well as to a pair of hinge plates 64 and 66; the upper plate 64 being removed in FIG. 5 to reveal drive gear detail. Plates 64 and 66 are securely fastened, by welding or the like, to the horizontally extending upper arm member 25. Although not necessarily required, it may be desireable to provide nylon or other substantially frictionless spacers 65 (FIG. 7) between gear 46 and plates 64 and 66 so as to ensure that the gear face 47 is maintained in proper alignment between the plates 64 and 66 as the gate rotates about hinge pin 48.

Extending through the member 25 along the full length thereof is a horizontal drive shaft 70 (together with any extensions thereof) which is journaled to a spacer block 72 by a bearing 74; to a block 76 by a bearing 78; and to an end plate 80 by a bearing 82. The blocks 72 and 76, and plate 80 are rigidly affixed (welded) to plates 64 and 66. Keyed to shaft 70, and held in place by spacers 84 and 86, is a helical worm gear 88 which engages gear 46 to cause rotation of the assembly including arm 25 about pivot 20.

Also keyed to shaft 70 and held in position between the blocks 76 and 80, and thrust bearing 90 and 82, is a drive gear 94 which is engaged and driven by a helical worm gear 96 that is keyed to a vertical stub shaft 98.

Also keyed to shaft 98 by means of a suitable coupling 100 (FIG. 6) is a drive shaft 102 which is journaled between a pair of plates 104 and 106 by bearing assemblies 108 and 110. Disposed between bearings 108 and 110 is a gear 112 which is keyed to shaft 102, and when driven by a gear 114, causes shaft 98 to rotate worm gear 96 (FIG. 5) which in turn drives gear 94 causing shaft 70 to rotate, thereby driving worm 88 against gear 46 and causing arm 25 and the associated gate unit 12 to rotate around the perimeter of gear 46.

As is more clearly shown in FIG. 8 of the drawing, gear 114 is attached to the drive shaft of a bi-directional DC motor 32 which provides opening and closing drive for the gate unit 12. Motor 32 is secured to plate 106 and vertical member 29 using conventional means.

Although not shown in detail (except as shown at 18 in FIGS. 1 and 2), in the preferred embodiment a simple upper hinge mechanism including a bracket similar to 42 (FIG. 7), a pair of plates similar to 64 and 66, and a hinge bolt together with suitable bearings is provided at the top of each unit to hingedly attached the upper portion of the unit to its supporting post. However, for certain applications in which more positive drive is required, a drive unit identical to that shown in FIGS. 5–8 may be utilized at the top hinge point, in which case a similar drive train will extend outwardly through the upper arm 23 (FIG. 2). Drive for the upper drive train may also be provided by the motor 32 by means of a coupling 116 (FIG. 8) and an upwardly extending shaft 118 which is coupled to an upper drive assembly similar to that illustrated in FIGS. 5–8.

Figure 9:
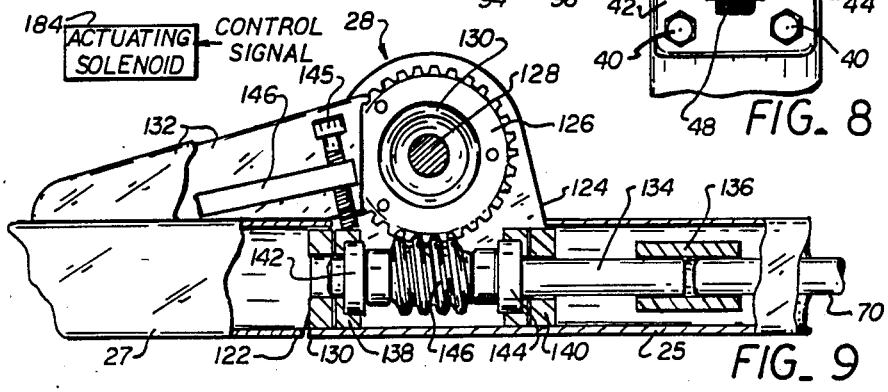
FIG. 9 is a partially broken plan view illustrating details of the elbow drive mechanism of the present invention.

Turning now to FIG. 9 of the drawing, details of the elbow joint provided at the pivot point 28 (and/or 26) will be described. As illustrated, the distal extremity 120 of upper arm member 25 engages a corresponding extremity 122 of forearm member 27. Affixed to member 25 is a pair of spaced apart plates 124 (only the lower of which is illustrated for clarity), and disposed therebetween is an elbow gear 126 which is journaled to plates 124 by means of a hinge bolt 128 and a pair of sealed bearings 130. Elbow gear 126 is sandwiched between and rigidly affixed to a pair of brackets 132 (the upper one being broken away for clarity) which are welded to forearm 27.

As indicated previously, the main drive shaft 70 extends through arm 25 (to a point where its distal end is coupled to an extension shaft 134 by means of a suitable coupling 136). Shaft 134 is journaled to a pair of spacer blocks 138 and 140 by bearings 142 and 144. Keyed to shaft 134 and spaced between bearings 142 and 144 by means of suitable spacers is a helical worm gear 146 which driveably engages gear 126. Upon rotation of shaft 70 and shaft 134, gear 146 is caused to rotate, in turn causing gear 126 and forearm 27 to be rotated about the hinge bolt 128. In order that arm 27 will rotate 180 degrees relative to upper arm 25 in response to the same rotation of shaft 70 that causes arm 25 to rotate 90 degrees relative to post 16 (FIG. 5), gears 126 and 46 are selected to have a 1-to-2 drive ratio. This results in the above described relative displacement of arms 25 and 29.

In order to provide an adjustable stop to ensure proper closed position alignment of forearm 27 relative to upper arm 25, an adjustment bolt 145 is threaded through a web 146 secured between the two plates 132. The distal end of bolt 145 provides a hard stop when it engages the rear surface of spacer 138.

In order to signal the remote motor control system 37 (FIG. 1) that the units 10 and 12 are in their closed (or open) positions, a pair of micro-switches 150 and 152 (FIG. 5) are affixed to the bracket 42. A switch actuator 154 is carried by arm 25 and is configured to have a first surface 156 which engages switch 150 when arm 25 is in its closed position and a second surface 158 which engages switch 152 when arm 25 is in its open position. In some systems it may also be desirable to provide additional interim position sensing switches which allow opening/closing motor speed control.

Figure 10:
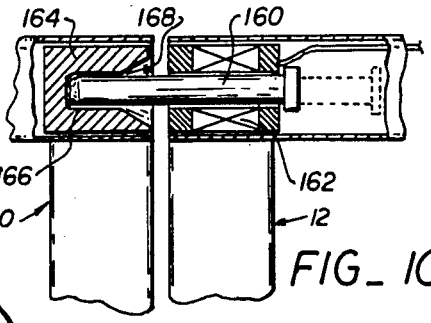
FIG. 10 is a partially broken elevational view illustrating a latching mechanism in accordance with the present invention.

Turning now to FIG. 10 of the drawing, one embodiment of a simple electrically actuated latching mechanism is disclosed. The mechanism includes a latch bolt 160 and actuating solenoid 162 carried within the arms 22 (and/or 27) of unit 12 and a keeper block 164 carried within the facing end of the upper (and/or lower) forearms of unit 10. Block 164 is provided with a cylindrical bore 166 for positively mating with pin 160. However, in order to assist in the alignment of bore and pin, the outer face of block 164 is conically tapered as indicated at 168.

Figure 12:
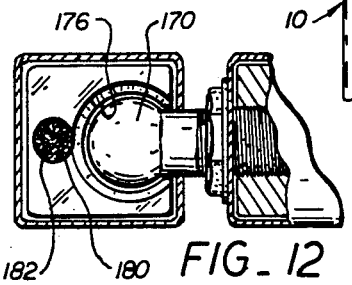
FIG. 12 is a cross section taken along the line 12—12 of FIG. 11.
Figure 11:
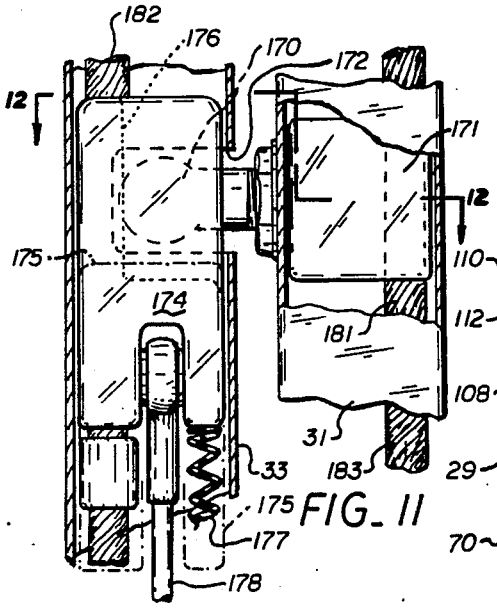
FIG. 11 is a partially broken elevational view illustrating an alternative latching mechanism in accordance with the present invention.

An alternative latching means is disclosed in FIGS. 11 and 12, and includes a ball-shaped latching stud 170 secured to the vertical member 31 of unit 12 (by being threaded into a block 171 contained internally of member 31), and a receiving notch 172 cut in the vertical member 33 of unit 10. Slideably disposed within member 33 is a latching block 174 having a vertically extending cylindrically-shaped groove 176 formed therein and extending vertically downwardly from the top thereof as indicated at 176 in FIG. 12 so as to form a "dove-tail" fit with the ball of stud 170. Secured to the bottom of member 174 is compression spring 177 and an actuator shaft 178 which extends to a suitable actuating solenoid 184. Spring 177 maintains block 174 in the normally closed position illustrated when the actuating solenoid is not energized. Also provided in both member 174 and member 171 are vertical bores 180 and 181 respectively, for receiving cables 182 and 183 for purposes which will be described hereinbelow.

In operation, as the gate units approach their closed positions, member 174 will be retracted downwardly by an actuating solenoid 184 and into the position illustrated by the dashed lines 175, thus clearing the opening 172 so that stud member 170 can be swung into penetrating disposition relative thereto. The actuator 184 is then denergized allowing member 174 to be driven upwardly by spring 177 to slide over and mate with ball head 170 and provide a positive lock of member 31 to member 33. It will of course be appreciated that a plurality of such locking mechanisms could be provided in a particular gate if desired.

Figure 14:
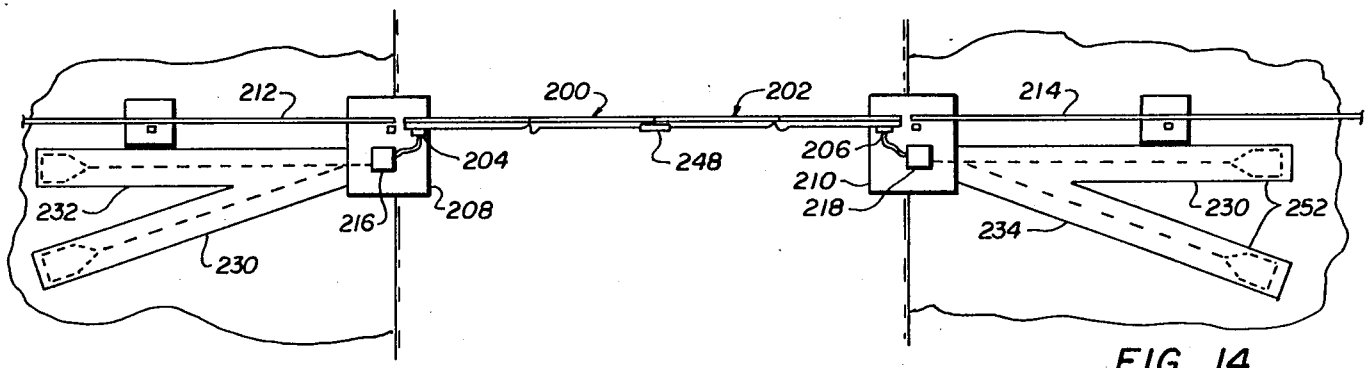
FIG. 14 is a top plan view further illustrating the gate and crash restraint system of FIG. 13.
Figure 13:
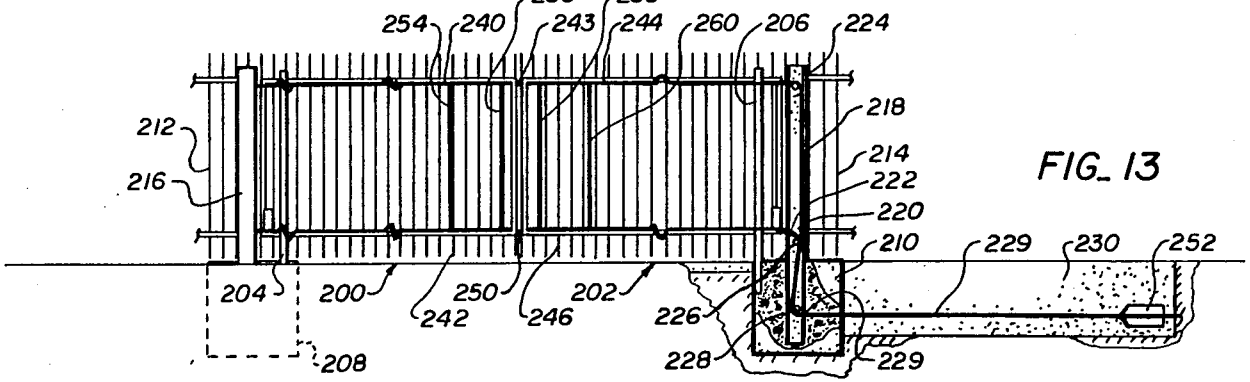
FIG. 13 is a partially broken rear elevational view illustrating a bifolding gate and crash restraint system in accordance with the present invention.

In FIGS. 13 and 14 of the drawing, a pair of gate units 200 and 202 are shown in a picket configuration and mounted to the posts 204 and 206 which are respectively embedded in concrete bases 208 and 210. Note that the rear sides of the gates and fence components 212 and 214 are illustrated in FIG. 13. In addition to the picket fence and gate structures, it will be noted that two concrete filled steel posts 216 and 218 are also embedded in the concrete bases 208 and 210 as particularly illustrated at 210 in FIG. 13. As depicted passageways 220 and 222 are also provided through the concrete filling of post 218 which pass over and around guide pins or rollers 224, 226 and 228. The entrance to passageway 220 is at the same elevation as the upper horizontal frame member, and the entrance to passageway 222 is at the same elevation as the lower horizontal frame member. The passageways both extend around pin 228 and out of post 218 at 229, and thence through conduits 230 and 232 which are bearied in trenches 234 and 236.

Note that extending along the upper and lower frame members of each gate unit are cables 240–246 which may either be fixed directly to the gate super-structure or pass through conduit affixed thereto (or even pass through a portion of the frame members per se). As indicated, the ends of upper cables 240 and 244 are joined together by coupling means 248, and the ends of the lower cables 242 and 246 are likewise joined together by a coupling means 250. In the preferred embodiment each of the cables is passed along the back side of the super-structure frame members and attached thereto by suitable clips or the like and thence passed through the passages 220 and 222 respectively, and conduits 229.

The opposite ends of each cable are secured to large and heavy plug-like members 252 the purpose of which is described below. The joined ends of the cables are also passed through the looped ends of vertically extending cables 254, 256, 258 and 260 which are either affixed to the black sides of, or passed through, the adjacent picket members. Because the cables are flexible and are loosely attached at the turning and bending parts of the gates, they do not interfere with the operation thereof. However, in the event that one were to attempt to crash through the closed gate, it will be appreciated that even though the gate per se might fail, the cable network will provide a snaring net that will envelope and restrain the crashing vehicle.

More specifically, as the vehicle violates the gate per se and the cables are drawn taught, the plugs 252 will be pulled through the trenches 230–236 (FIG. 14) absorbing the kinetic energy of the moving vehicle mass until the plugs make a hard stop as they engage the concrete footing blocks 208 and 210. At this point the snared vehicle will be completely stopped. By judiciously selecting the type of material used as ballast in the trenches 230–236, as well as the shape of the plugs 252, the arresting forces can be carefully selected so that cables of relatively small diameter can be utilized, thereby providing the desired restraint without distracting from the aesthetic appearance of the gate. It will be appreciated that although the illustrated restraint system is shown with a bifold gate, it can also be used with other types of gates as well.

Figure 15:
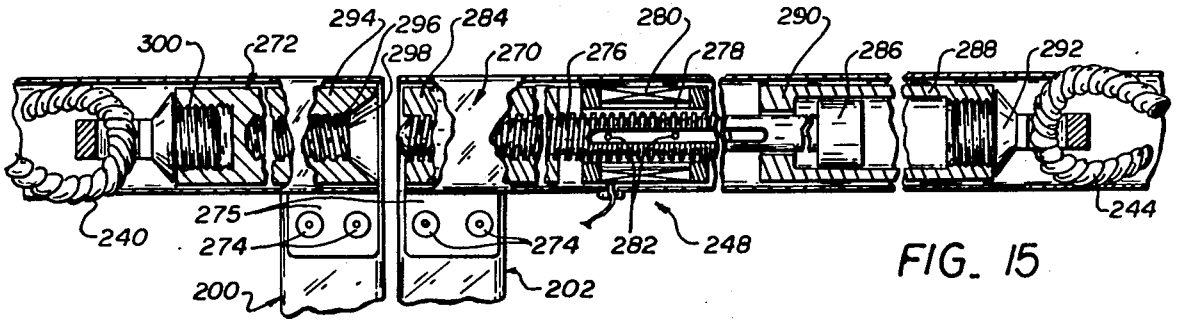
FIG. 15 is a partially broken elevational view illustrating an alternative embodiment of a gate latching mechanism suitable for use in accordance with a restraint mechanism of the type illustrated in FIGS. 13–15.

Referring now to FIG. 15 of the drawing, one embodiment of an electrically actuated cable coupling mechanism suitable for use in attaching the cable ends of the embodiment depicted in FIGS. 13 and 14 is shown at 248. As illustrated, the mechanism is comprised of a male coupling unit 270 and a female coupling unit 272 which are affixed to gate units 200 and 202 by means of bolts 274. The bolts 274 and mounting brackets 275 are selected so as to be frangible and to allow the units to 270 and 272 to separate from the gate members before any substantial shearing forces are transmitted from the gate members to the coupling units sufficient to sheer any elements of the coupling mechanism.

As illustrated, the male component 270 includes a threaded lead screw member 276 which passes through a bore in the armature 278 of bi-directional DC motor 280. Armature 278 is rotationally coupled to screw member 276 by means of pins 282 which cause screw 276 to be rotated but at the same time allow it to move axially relative to amature 278 and to thread in and out of the internally threaded end block 284. The butt end of screw 276 terminates in a piston-like member 286 disposed within the bore of a mating sleeve 288 which terminates at one end in a thickened wall with a reduced diameter opening 290 and is threaded at the other end to receive a threaded plug 292 that is attached to a terminating loop in the cable 244. It will be appreciated that the sleeve 288 permits screw 276 to rotate relative to cable 244 without causing a twist to be imparted thereto.

The female unit 272 is comprised of a block 294 having an internally threaded bore 296 for matingly receiving screw 276. The opening 288 to bore 296 is conically configured to assist in the mating operation, and to overcome any slight misalignment between the two gate units. The left-most end of block 294 is provided with a threaded fixture 300 having an eyelet for receiving the looped end of cable 240. It will be appreciated that this device can be used either as the principal gate latching mechanism or as a secondary latching source whose primary function is to serve as a cable tie.

One advantage of making the unit independent of the gate latching mechanism is that for monitored gate installations where the gate might be opened and closed on many occasions, a simpler latching mechanism such as that shown in FIG. 10 can be utilized with the cable tieing means of FIG. 15 being temporarily disabled for the sake of convenience and only used when the gate is unattended, or during high risk periods, etc.

Another advantage is that by making the cable coupling means free to separate from the gate structure, it does not depend upon the structural integrity of the gate in any way, and the gate units will be less likely to impose substantial shearing forces upon either the screw member 276 or the cables.

Referring now to FIG. 16, an alternate embodiment of a cabling configuration is illustrated which allows a single cable loop 306 to be routed in "figure 8" fashion behind the silhouette of the super-structure 308 and then be joined at 309 and passed through a hard stop block 312 to terminate in a bearied plug like unit 314 disposed suitable distance away. In this embodiment, the cable is passed through at least the outboard frame members and through latching mechanisms of the type illustrated in FIGS. 11 and 12, with such means being positioned at 316. One advantage of this alternative is that, in addition to avoiding the necessity of cutting a continuous cable at any point, the portions of the loop extending vertically at 318 (usually through a vertical conduit or picket element) accommodate the folding action of the gate unit sub-components. It will of course be appreciated that additional cables or loops thereof in any suitable configuration can be utilized.

In FIGS. 17 and 18 additional modifications of the present invention are indicated which (1) allow the gate to be opened in the case of a loss of power to the drive motors, and (2) allow the closure drive mechanism to in effect be disengaged in the event of a minor impact (such as a car backing into the closed gate) without causing substantial damage to the gate or drive train. As illustrated in FIG. 17, the pivot post 14 (and 16 in FIG. 1) is formed in two pieces 340 and 342, and the mating ends are welded to plates 344 and 346 respectively, and rigidly supported relative thereto by bracing webs 348 and 350 which are also welded to both post and plate. The plates 344 and 346 are secured to each other by a clamping bolt 352 which is disposed along the longitudinal axis of the post and clamps the plates tightly together, but allows them to rotate in sliding engagement with each other about the axis of bolt 352. As in other embodiments the lower end 342 of post 14 is embedded in concrete 343.

In order to prevent the post segment 340 and plate 344 from rotating about its axis relative to post segment 342 and plate 346, a shear pin 354 is extended through an opening 356 in plate 344 and into a bore 358 in plate 346. It will be appreciated that by carefully selecting the pin configuration, size and shear properties, the pin can be used as a means of preventing damage to the superstructure and/or gear train by virtue of its ability to yield and allow rotation of the entire gate assembly in the event that the torque imposed between gate and post exceeds a selected limit.

Depending upon the desired release characteristics selected, it may be desirable to additionally provide other relative motion resistance means such as spring loaded detents, and the like, as is illustrated at 360. Depending upon the defect and recess characteristics (and the number of such devices utilized) it will be appreciated that pin 354 can be isolated from shear loads until the torque forces imposed on the assembly exceed the holding capacity of the detents 360.

It will also be appreciated that a suitable locking mechanism 370 can be incorporated into the shear pin structure as indicated in FIG. 18. In either case, the removal of the keyed pin can also be used as a means of allowing emergency gate opening.

In another embodiment of the present invention illustrated in FIGS. 19 through 21, the hinging apparatus and drive train are modified so as to allow the bifolding super-structure to rotate substantially 180 degrees (rather than the 90 degrees allowed by the other embodiment) from its closed position to an open position adjacent an adjoining fence or wall. More specifically, in FIG. 19 a supporting post 400 is shown in combination with the lower portion of a vertical frame member 402 and a horizontal lower frame member 404. In this case, the hinge plates 406 and 408 are affixed to the vertical side wall of frame member 402, and the hinge bracket 410 carries an arcuate segment of gear 412 exceeding 180 degrees (see FIG. 20). Plates 406 and 408 are journaled to bracket 410 by a hinge bolt 414 and suitable bearing means (not shown) in a manner similar to that described above. Disposed within member 404 is a horizontally extending shaft 416 similar to the shaft 70 illustrated in the FIGS. 5 through 8, except that as depicted in FIG. 19, at the right-most end thereof a bevel gear 418 is affixed. Disposed within the vertical member 402 is a shaft 420 having gears 422, 424 and 426 affixed thereto. Gear 422 engages main gear 412, gear 424 is engaged by a worm gear 428 attached to the drive shaft of motor 430, and 426 is a bevel gear which engages bevel gear 418.

Since the gear ratio of an ordinary gear set, such as that shown at 412 and 422 in FIGS. 19 and 20, is substantially different from the gear ratio of a worm gear combination such as that shown at 46 and 88 in FIG. 5, it is necessary that the elbow gearing be changed. In this embodiment, the shaft 416 drives a bevel gear 440 attached to a vertically shaft 444 which is journaled between bearings 446 and 448 at the top and bottom surfaces of member 404. Attached to the upper end of shaft 444 is a gear 450 which meshes with the elbow gear 452. As in the previously described elbow, gear 452 is attached to member 405 by means of one or more brackets 454. However, in this case the gear is disposed slightly above the upper surface of member 405 rather that behind the member. Member 405 is hingedly secured to member 404 by means of hinge bolt 456 and bracket structure 458 which is welded to member 404.

It will thus be appreciated that as shaft 416 rotates it in turn rotates shaft 444 and gear 450 by means of the bevel gears 440 and 442, and gear 450 in turn drives gear 452 causing member 405 to rotate about hinge bolt 456. It is of course understood that the upper portions of the frames including members 404 and 405 are hinged together by an upper hinge mechanism as well as the lower hinge mechanism illustrated, and that the inboard frame including member 404 is hingedly attached to post 400 by a suitable upper hinge mechanism (not shown).

By selection of the appropriate relationship between gears 412 and 422, and the elbow gears it will be appreciated that whereas during the opening operation of the earlier described embodiment the outboard frame rotated 180 degrees relative to the inboard frame and the inboard frame rotated 90 degrees relative to the support post, in the embodiment illustrated in FIGS. 19–21 the outboard frame 405 rotates substantially 180 degrees relative to the inboard frame 404 as the inboard frame rotates substantially 180 degrees relative to post 400.

This embodiment offers the additional advantage over the earlier described embodiment that it allows the entire closure to be foled and parked along side an adjoining fence or wall, as indicated by the dashed lines 407.

Although not illustrated in the drawing, it will be appreciated that appropriate shrouds will be provided to enclose the motor 430 and gear 412 as well as the elbow gear. It will also be appreciated that although the arrangement depicted is one in which the folded fence closure is intended to be parked outside the adjacent fence or wall as indicated in FIG. 21. One can alternately configure the device so that it is parked inside the fence or wall. In such case the elbow gear 409 and motor 430 would be placed on the opposite side of the closure frames and the exterior side of the closure would be considered that facing upwardly instead of that facing downwardly as shown in FIG. 21.

Although as above described the present invention has been directed to a bifolding closure super-structure including hinges, drive train and drive motor, it will be appreciated that as depicted in FIG. 22, an independent combination of the disclosed "forearm" (450) "elbow gear" (452), "upper arm" (454), "drive train" (enclosed within arm 454 and motor housing 456, "shoulder gear" (458) and "drive motor" (enclosed in housing 456) also forms an embodiment of the invention known as the "Hamrick Arm" which can be attached to an independently suspended bifolding gate or solid closure, as illustrated by the dashed lines 460. In such embodiment, a plate 451 including attachment flanges 453 and 455 is used as the forearm 450. Upper arm 454 and motor housing 456 remain substantially unchanged from that previously described except that theris no vertical frame member, and flanges 457, 459 and 461 are provided. Attachment of gear 458 to a supporting post is by plate 460.

Operation of the Hamrick Arm is as previously described. Note also that a version thereof similar to the embodiment of FIGS. 19–21 can also be provided.

These and other alterations and modifications of the present invention will no doubt become apparent to those skilled in the art after having read the preceding disclosure. It is therefore intended that the appended claims be interpreted as covering all such alterations and modifications as fall within the true spirit and scope of the invention.

What is claimed is:

1. An electromechanically actuated bifolding closure apparatus comprising:

post means;

means forming a super-structure for supporting a closure means and including a first generally C-shaped frame having a first vertically extending member and a first pair of horizontally extending members each of which is rigidly connected to one end of said first member, a second generally C-shaped frame having a second vertically extending member and a second pair of horizontally extending members each of which is rigidly connected to one end of said second member;

first hinge means connecting the distal ends of said first pair of members to the distal ends of said second pair of members;

second hinge means connecting said second frame to said post means;

first gear means associated with said first hinge means and fixedly attached to said first frame;

second gear means associated with said second hinge means and fixedly attached to said post means;

electric motor means carried by said second frame; and gear train means carried by said second frame and operatively coupling said motor means to said first gear means and said second gear means whereby actuation of said motor means causes said first frame to rotate about said first hinge means between a first disposition relative to said second frame and a second disposition relative to said second frame, and causes said second frame to rotate between a first disposition relative to said post means and a second disposition relative to said post means.

2. An electromechanically actuated bifolding closure apparatus as recited in claim 1 wherein the axis of rotation of said first hinge means lies in a plane parallel to but spaced from a plane defined by either said first frame or said second frame.

3. An electromechanically actuated bifolding closure apparatus as recited in claim 2 wherein the axis of rotation of said second hinge means lies in a plane parallel to but spaced from a plane defined by said second frame.

4. An electromechanically actuated bifolding closure apparatus as recited in claim 1 wherein at least one of said second pair of horizontally extending members is tubular in configuration and wherein at least a portion of said gear train extends therethrough.

5. An electromechanically actuated bifolding closure apparatus as recited in claim 4 wherein said second vertically extending member is tubular in configuration and at least a part of said gear train means extends therethrough.

6. An electromechanically actuated bifolding closure apparatus as recited in claim 1 wherein said gear train means includes a horizontally extending shaft means having a first worm gear affixed thereto proximate one end thereof for engaging said first gear means, and a second worm gear affixed thereto proximate the other end thereof for engaging said second gear means, the gear ratios between said first gear means and said first worm gear, and said second gear means and said second worm gear being selected such that a predetermined number of rotations of said shaft means will cause said first frame to rotate through a first predetermined angle relative to said second frame and will cause said second frame to rotate through a second predetermined angle relative to said post means.

7. An electromechanically actuated bifolding closure apparatus as recited in claim 1, wherein said gear train means includes a horizontally extending shaft means having a first bevel gear affixed thereto at one end thereof, and a second bevel gear affixed thereto at the other end thereof, a first vertically extending shaft means having a third bevel gear affixed thereto at one end thereof for engaging said first bevel gear, and a first pinion gear attached thereto for engaging said first gear means, a second vertically extending shaft means having a fourth bevel gear attached to one end thereof for engaging said second abevel gear, and a second pinion gear attached thereto for engaging said second gear means; and means for coupling said motor means to said gear train means, whereby rotation of said horizontally extending shaft means and said first and second vertically extending shaft means causes said second frame to be rotated through a first predetermined angle relative to said post means, and said second frame to be rotated through a second predetermined angle relative to said first frame.

8. An electromechanically actuated bifolding closure apparatus as recited in claim 7 wherein said means for coupling said motor means to said gear train means includes another gear means affixed to said vertically extending shaft means and a worm gear affixed to the drive shaft of said motor means for engaging said another gear means to impart rotational energy thereto.

9. An electromechanically actuated bifolding closure apparatus as recited in claim 1 and further comprising:

latching means for latching said first frame to either another post means or to another bifolding closure apparatus;

elongated channel means filled with energy absorbing mass and extending outwardly from said post means;

plug means disposed within said channel means proximate the end thereof remote from said post means and bearied beneath said mass; and cable means extending from said plug means through said channel means to a point proximate said post means and thence along said second frame and said first frame to said latch means whereby an intruding object penetrating the closure apparatus will be restrained by said cable means and the energy generated in restraining the object will be absorbed by said mass as said plug means is drawn through said channel means.

10. An electromechanically actuated bifolding closure apparatus as recited in claim 9 and further comprising:

cable guide means disposed proximate said post means and including passageways formed therein having entrances proximate each of said second pair of horizontally extending members, and exits disposed beneath ground level and in communication with said channel means, said latching means including a first latch disposed proximate an end of one of said first horizontally extending members and a second latch disposed proximate the other of said first horizontally extending members, said cable means including a first cable extending from said first latch along an upper portion of said first and second frames and thence through said passageways and said channel means to said plug means, and a second cable extending from said second latch along a lower portion of said first and second frames and thence through said passageways and said channel means to said plug means.

11. An electromechanically actuated bifolding closure apparatus as recited in claim 10 and further comprising a plurality of additional lengths of cable spaced apart along at least said first frame and tieing said first cable to said second cable to form a network for snaring an object attempting to penetrate the closure apparatus.

12. An electromechanically actuated bifolding closure apparatus as recited in claim 1 and further comprising first detecting means for detecting when said second frame is in said first disposition relative to said post means and a second detector means for detecting when said second frame is in said second disposition relative to said post means; and electrical control means coupled to said first and second detecting means and which upon actuation will energize said motor means to drive said closure apparatus from an open position to a closed position and vice versa, and upon receipt of an output generated by one of said first and second detector means will cause said motor means to be de-energized.

13. An electromechanically actuated bifolding closure apparatus as recited in claim 12 wherein said motor means is a DC motor and said control means includes means for converting input alternating current energy to direct current energy for driving said motor.

14. An electromechanically actuated bifolding closure apparatus as recited in claim 1 and further comprising protective means for allowing said closure apparatus to rotate about the axis of said post means in the event that a force is applied to said closure apparatus causing a torque exceeding a predetermined limit to be imposed upon said post means, thereby protecting said drive train and super-structure from substantial damage.

15. An electromechanically actuated bifolding closure apparatus as recited in claim 14 wherein said protective means in comprised of a rotatable base attached to said post means, and shear pin means for preventing said post means from rotating relative to said base means until said shear pin means is sheared or removed.

16. An electromechanical actuating apparatus for operating a bifolding closure including a first closure portion hingedly attached by first hinge means to a second closure portion which is hingedly attached by second hinge means to a support, comprising:

first gear means including a first driven gear adapted to be fixedly attached to said first closure portion, and a first driving gear for drivingly engaging said first driven gear;

second gear means including a second driven gear adapted to be fixedly attached to said support, and a second driving gear for drivingly engaging said second driven gear;

electric motor means adapted to be carried by said second closure portion; and gear train means adapted to be carried by said second closure portion and operatively coupling said motor means to said first driving gear and said second driving gear whereby actuation of said motor means causes said first closure portion to be rotated about the first hinge means between a first disposition relative to said second closure portion and a second disposition relative to said second closure portion, and causes said second closure portion to be rotated between a first disposition relative to said support and a second disposition relative to said support.

17. An electromechanical actuating apparatus as recited in claim 16 and further comprising:

means forming a forearm structure for attaching said first driven gear to said first closure portion, and an elongated tubular member forming an upper arm structure for housing at least a part of said gear train means.

18. An electromechanical actuating apparatus as recited in claim 17 wherein said gear train means includes a horizontally extending shaft means having a first worm gear forming said first driving gear and disposed proximate one end thereof for engaging said first driven gear, and a second worm gear forming said second driving gear and disposed thereon proximate the other end of said shaft means for engaging said second driven gear, the gear ratios between said first driven gear and said first worm gear, and said second driven gear and said second worm gear being selected such that a predetermined number of rotations of said shaft means will cause said first closure portion to be rotated through a first predetermined angle relative to said second closure portion and will cause said second closure portion to be rotated through a second predetermined angle relative to said support.

19. An electromechanical actuating apparatus as recited in claim 17 wherein said gear train means includes a horizontally extending shaft means having a first bevel gear disposed at one end thereof, and a second bevel gear disposed at the other end thereof, a first vertically extending shaft means having a third bevel gear disposed at one end thereof for engaging said first bevel gear and a first pinion gear disposed at the other end and forming said first driving gear, a second vertically extending shaft means having a fourth bevel gear at one end for engaging said second bevel gear and a second pinion gear forming said second driving gear; and means for coupling said motor means to said gear train means, whereby rotation of said horizontally extending shaft means and said first and second vertically extending shaft means causes said first closure portion to be rotated through a first predetermined angle relative to said second closure portion, and said second closure portion to be rotated through a second predetermined angle relative to said first support.

20. An electromechanical actuating apparatus as recited in claim 18 wherein said means for coupling said motor means to said gear train means includes another gear means affixed to said second vertically extending shaft means and a worm gear affixed to the drive shaft of said motor means for engaging said another gear means to impart rotational energy thereto.

21. An electromechanical actuating apparatus as recited in claim 17 and further comprising first detecting means for detecting when said forearm structure is in said first disposition relative to said support and a second detector means for detecting when said forearm structure is in said second disposition relative to said support; and electrical control means coupled to said first and second detecting means and which upon actuation will energize said motor means to drive said first and second closure portions from an open position to a closed position and vice versa and upon receipt of an output generated by one of said first and second detector means will cause said motor means to be de-energized.

* * * * *